United States Patent [19]

Simpson

[11] Patent Number: 4,866,485

[45] Date of Patent: Sep. 12, 1989

[54] MOLDED SKIVE AND GUIDE

[75] Inventor: Brian A. Simpson, North Chili, N.Y.

[73] Assignee: Eastman Kodak Company, Rochester, N.Y.

[21] Appl. No.: 246,579

[22] Filed: Sep. 19, 1988

[51] Int. Cl.[4] ..... G03G 21/00

[52] U.S. Cl. ..... 355/315; 355/282; 271/311; 271/900

[58] Field of Search ..... 355/3 FU, 14 FU, 3 SH, 355/14 SH; 271/900, 307, 308, 309, 310, 311, 312, 313; 219/216

[56] References Cited

U.S. PATENT DOCUMENTS

| | | | |
|---|---|---|---|
| 4,384,781 | 5/1983 | Takada | 219/216 X |
| 4,447,054 | 5/1984 | Sone | 271/900 X |
| 4,536,076 | 8/1985 | Bickerstaff et al. | 355/14 FU X |
| 4,551,007 | 11/1985 | Elter | 355/14 FU |
| 4,571,054 | 2/1986 | Bowler, Jr. | 355/3 FU X |

*Primary Examiner*—Arthur T. Grimley
*Assistant Examiner*—Barry J. Shapiro
*Attorney, Agent, or Firm*—Tallam I. Nguti

[57] ABSTRACT

A sheet stripping and guide assembly, suitable for use at the exit of an electrostatographic fusing station has lower stripper fingers that are inserted and molded integrally into a frame having upper sheet guide members.

14 Claims, 2 Drawing Sheets

MOLDED SKIVE AND GUIDE

BACKGROUND OF THE INVENTION

The present invention relates to skive devices, and more particularly to an improved skive and sheet guide device that can be used for stripping and guiding a copy sheet from a fuser roller in an electrostatographic apparatus.

The use of skives for stripping sheet-like members from surfaces in various types of apparatus, is well known. More specifically, it is well known to use a skive for stripping copy sheets from the surfaces of fuser rollers in electrostatographic apparatus. A fuser roller in such apparatus commonly has a soft, flexible outer surface that is flexed as a copy sheet is conveyed through the nip formed between the fuser roller and a backup roller, or between two fuser rollers. This soft surface of the fuser roller can be damaged by the stripper fingers of a skive when the skive is being loaded against the fuser roller surface, and when copy sheet jams occur at the fusing station. Repeated jams can also knock the stripper fingers out of adjustment relative to the fuser roller, thereby necessitating readjustments.

In addition, copy sheets stripped from the fuser roller must also be guided to continue moving in a defined path, and away from the fusing station. Such copy sheets, if allowed to curl or buckle as each exits the fusing station, are likely to cause jams. Guide members therefore are used cooperatively with the stripper fingers to limit the deflection and curl in such sheets as each exits the fusing station.

Typically, the guide members are mounted on a bar adjacent the backup roller and the stripper fingers are mounted on a separate bar adjacent the fuser roller. The gapping between the two bars therefore requires adjustment for proper copy sheet path control. Consequently, the guides and the fingers are either mounted to each bar with screws or other fasteners which can come loose, or they are spring-clamped to the bars - a practice that frequently results in loose guides and fingers. The fingers, in addition, have to be assembled to the bar in the field, and must therefore be adjusted and readjusted individually.

Guide members and stripping fingers mounted and adjustable as described here, are expensive and costly to maintain. It will therefore be advantageous to provide a one-piece preassembled skive and guide assembly that includes no loose parts and no screws or similar fasteners, and that requires no field gapping or expensive adjustments.

SUMMARY OF THE INVENTION

Accordingly, it is an object of the present invention to provide a one-piece skive and guide assembly that requires no gapping adjustments.

Another object of the present invention is to provide a skive and guide assembly with preassembled fingers and guides ready for field use.

A further object of the present invention is to provide a skive and guide assembly that includes no screws or fasteners, and no risk of spring-loaded parts becoming loose.

In accordance with the present invention, therefore, a one-piece device is provided for stripping and guiding sheet-like members away from a surface. The device comprises a molded frame that has first and second elongate sides which in part define a generally rectangular opening. The frame is mounted across the exit of the fusing nip of a fusing station in an electrostatographic copier or printer so that copy sheets exiting the fusing nip are effectively stripped from the fuser roller and guided into, and through the rectangular opening. Stripper fingers inserted and integrally molded into the first side of the frame, strip copy sheets tending to stick to the fuser roller, and guide members integrally molded as a part of the second side of the frame, operate to guide the copy sheets into the rectangular opening.

The frame structure predetermines the gapping between the stripper fingers and the guide members, and the integral molding of the fingers and the guide members with the frame eliminates the need for screws or other fasteners. The whole assembly is inexpensive to manufacture and can be made disposable when replacement is necessary.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
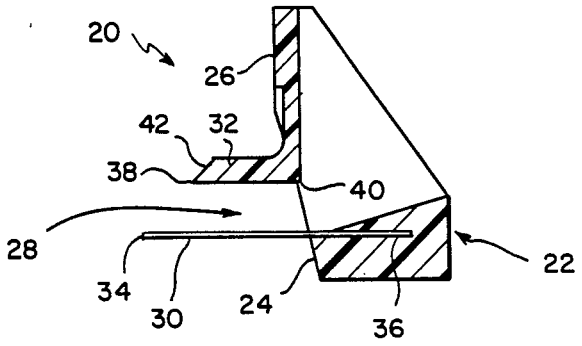
FIG. 1 is a cross-sectional view of the skive and guide device prior to being mounted in an electrostatographic apparatus.
Figure 2:
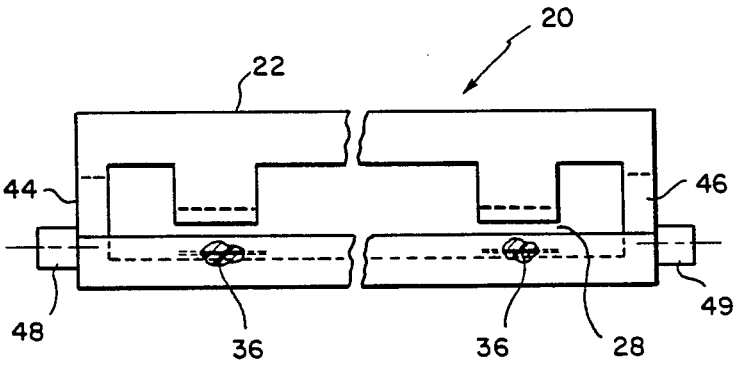
FIG. 2 is a backside view of the frame of the present invention with appropriate cutouts for detail.

Referring now to the drawings, a one-piece copy sheet skive and guide device of the present invention is generally designated 20. As shown in FIGS. 1 and 2, the device 20 comprises a frame 22 that has first and second elongate sides 24, 26, which in part define a generally rectangular opening 28. The frame 22 can be molded from a material such as plastic. Flat flexible fingers 30, suitable for stripping sheet-like members from a surface, are associated with the first side 24 of the frame, and flexible guide members 32 are associated with the second side 26 of the frame. Relative to the guide members 32, the stripper fingers 30 are thinner, longer and more flexible.

Each finger 30, which may be metallic, has a rounded sheet stripping tip 34 and a base 36. The fingers which are straight, involving no bends, are integrally and permanently molded with the frame 22. To do so, the base 36 of each finger is inserted into the mold according to the design of the mold before the frame 22 is formed therein. When molded into the frame as such, the tips 34 of the fingers 30 project from the first side 24 of the frame, and the bases 36 meet such first side to form a smooth plane into and through the rectangular opening 28.

Guide members 32, each of which also has a tip 38 and a base 40, project from the second side 26 of the frame. The guide members 32 are preferably made of the same material as the frame 22, and are molded integrally as a part of the frame with their bases connected to the second side 26 of such frame. When the device 20 is not mounted for operation against a surface, the projecting fingers 30 and the guide members 32 are parallel, forming opposing planes into the opening 28. In order to facilitate precise loading against, or in close proximity to, a roller surface (FIGS. 3 and 4), the outside portion 42 of the tip 38 of each guide member 32 can be beveled. Although sheets rarely tend to curl towards the pressure roller because of the tackiness of toner on the fuser roller side of each sheet, because of such beveling, the tip 38 is able to ride close enough to the pressure roller so as to prevent any sheets tending to curl and follow the pressure roller.

Figure 3:
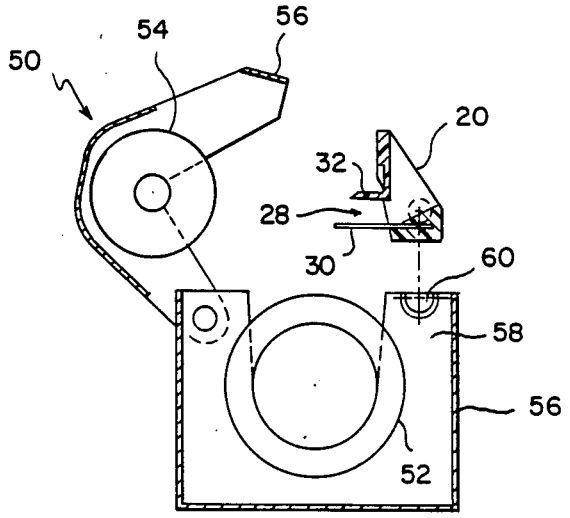
FIG. 3 illustrates a preferred manner of loading the device of the present invention into the fusing station of an electrostatographic apparatus.
Figure 4:
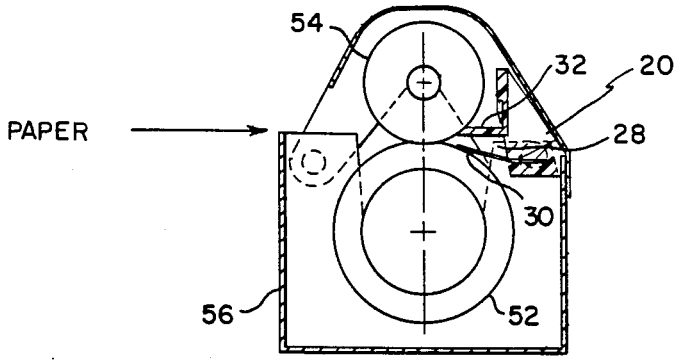
FIG. 4 is an illustration of the device of the present invention loaded for operation in such a fusing station.

As illustrated in FIGS. 2, 3 and 4, the frame 22 has ends 44, 46, and stub shafts 48, 49 projecting from each such end respectively for mounting to a support in a fusing station 50.

The fusing station 50 is preferbly the type in which a fuser roller 52 and a backup roller 54 are contained in a lunchbox type enclosure 56, and in which the backup roller 54 can pivot into nip engagement with, and out of such engagement with, the fuser roller 52. The station enclosure 56 includes supports 58 at each end of the rollers 52, 54 and each such support has a recess 60 with retaining means therein suitable for receiving and holding the stub shafts 48, 49 in an operative position with the fusing station.

As shown in FIG. 3, the device 20 is loaded to the station 50 preferably when the backup roller 54 has been pivoted away from the fuser roller 52. With the fingers 30 and the guide members 32 held away from the fuser roller 52, the stub shafts 48, 49 are lowered into the recesses 60, and then rotated to bring the portions of the fingers near the tips 34 into sliding contact with the surface of the fuser roller 52. In this manner, the tips 34 of the fingers are less likely to spear and damage the soft surface of the fuser roller. When the stub shafts 48, 49 are fully rotated into a retained loaded position within the recesses 60, the fingers 30 will be flexed (FIG. 4) so that each finger forms an acute angle with the surface of the fuser roller suitable for stripping any copy sheets tending to stick to the fuser roller. At this stage the stripper fingers 30 and the guide members 32 are no longer parallel, but are spaced apart to, in-part, define a sheet travel path into the opening 28.

The loading of the device 20 is completed by pivoting the backup roller 54 back into nip engagement with the fuser roller 52. However, before the two rollers engage, the backup roller 54 first contacts the beveled portion 42 of the tip 38 of each guide member, flexing each such tip 38 towards the nip area, and towards the stripping fingers 30. With the fingers 30 already in a position to strip copy sheets from the fuser roller 52, and with the guide members 32 positioned as such against the backup roller, the device 20 will effectively strip such sheets and prevent any curling or buckling of the sheets as the sheets exit the fusing nip. In this manner, the device 20 guides each sheet along the sheet travel path, into and through the opening 28 in the frame.

Because the stripping fingers 30 and guide members 32 are integrally and permanently formed with the frame 22, they are unlikely to come loose through normal use or through jams, if any, and in addition, they will tend to maintain their adjustments relative to the fusing station rollers 52, 54. When it ever becomes necessary through wear and tear, to replace any of the fingers or guides, it is preferable to remove the entire device 20 and to replace it with a new one. Since the fingers 30 are already adjusted to proper spacing from the guides 32 at the time of molding the device 20, no finger adjustments are therefore necessary during such replacement.

To unload the device from the fusing station 50, the backup roller 54 and the top portion of the enclosure 56 are first manually pivoted away from the fuser roller 52, and the stub shafts 48, 49 rotated to move the fingers 30 away from the fuser roller. Next, the stub shafts are lifted out of the recesses 60, and the old device taken out. A new device is then reloaded into the station as described above.

Although the detailed description has been made with particular reference to a preferred embodiment of the invention, it will be understood that variations and modifications can be effected within the spirit and scope of the invention.

I claim:

1. In the fusing station of an electrostatographic copier or printer where toner images are fused to substrates such as sheets of paper by means of a fuser roller and a backup roller which have operative positions in contact with each other forming a fusing nip, a one-piece device for stripping and guiding the substrates away from the rollers, the device comprising:

(a) a molded frame having first and second elongate sides mounted across the exit of the fusing nip of the fusing station;

(b) a generally rectangular opening defined in part by said first and second sides of said frame for receiving and passing substrates from the fusing nip;

(c) a stripper finger for stripping substrates from the fuser roller, said finger having a tip suitable for riding on the surface of the fuser roller, and a base permanently molded into said first side of said frame; and (d) a guide member for guiding substrates through said opening in said frame, said guide member having a base connected to said second side of said frame, and a tip positioned in close proximity to the surface of the backup roller.

2. The invention as set forth in claim 1 wherein said frame is molded from a plastic material.

3. The invention as set forth in claim 1 wherein said means for mounting a frame includes a support at each end of the fuser and backup rollers, each such support having a recess therein with retaining means suitable for receiving and holding a shaft member; and a stub shaft member at each end of said frame for manually mounting into each said recess in each support.

4. The invention as set forth in claim 1 wherein said frame is mounted across the fusing nip such that said first side of the frame is in close proximity and parallel to the fuser roller, and said second side of the frame is in close proximity and parallel to the backup roller.

5. The invention as set forth in claim 1 wherein said guide member is molded integrally with, and out of the same material as said frame.

6. The invention as set forth in claim 1 wherein the outside portion of said tip of said guide member is beveled.

7. The invention as set forth in claim 1 wherein said guide member is flexible.

8. The invention as set forth in claim 1 wherein said stripper finger is metallic.

9. The invention as set forth in claim 1 wherein said stripper finger is flexible.

10. The invention as set forth in claim 1 wherein said tip of said stripper finger is rounded to eliminate sharp corners.

11. The invention as set forth in claim 1 wherein said first side of the frame has a plurality of said stripper fingers molded therein.

12. The invention as set forth in claim 1 wherein said second side of the frame has a plurality of said guide members connected thereto.

13. The invention as set forth in claim 3 wherein said recesses in said supports are located relative to the fuser roller such that when said frame is mounted therein, a portion of the finger adjoining the tip contacts the fuser roller and flexes in order for the tip to form an acute angle with the surface of the fuser roller suitable for stripping substrates therefrom.

14. The invention as set forth in claim 3 wherein said frame is manually mountable into said recesses with the backup roller out of contact with the fuser roller, and wherein the backup roller upon being brought into contact with the fuser roller, contacts the outside portion of said tip of said guide member, flexing said guide member and forming an acute angle therewith.

* * * * *